United States Patent [19]

Simon

[11] 4,230,131

[45] Oct. 28, 1980

[54] SELF-EXTINGUISHING CIGARETTES

[76] Inventor: Eli Simon, 7175 Little Harbor Dr., Huntington Beach, Calif. 92648

[21] Appl. No.: 11,129

[22] Filed: Mar. 9, 1979

[51] Int. Cl.[3] ..... A24D 1/10

[52] U.S. Cl. ..... 131/4 A

[58] Field of Search ..... 131/4 A, 8 A; 252/81

[56] References Cited

U.S. PATENT DOCUMENTS 1,996,002 3/1935 Seaman ..... 131/4 A

OTHER PUBLICATIONS

"The Chemistry & Uses of Fire Retardants" by Lyons: Published by Wiley-Interscience, 1970: p. 58 cited.

*Primary Examiner*—V. Millin

[57] ABSTRACT

This invention concerns the identification of additives and methods of their incorporation as applied to cigarettes, having for its purpose a predictable reduced free burning time. Of those additives disclosed in this specification, boric acid and benzenephosphonic acid are preferred used within a range of 2.5 to 5.5 weight percent based on the weight of the tobacco. Of the methods of incorporation disclosed, including those of direct addition via aqueous and isopropanol solutions of the additives into the tobacco of assembled cigarettes, treatment separately of both the tobacco and the paper housing prior to assembly, and treatment of the paper housing only prior to assembly, that of immersion of the assembled cigarettes into aqueous solutions of the additives for controlled periods of time is preferred. Within a range of 3±1.5 g. boric acid, benzenephosphonic acid, and mixed boric acid-benzenephosphonic acid per 100 ml. aqueous solution, an immersion time of 1 to 4 seconds (as a inverse function of additive concentration) provides an adequate range to meet the varying existing conditions of cigarette sizes and tobacco contents. Using the preferred additives and the preferred method of incorporation, a self-extinguishing time of 1 to 3 minutes can be expected and is considered to meet the objective of this disclosure.

4 Claims, 1 Drawing Figure

SELF-EXTINGUISHING CIGARETTES

BACKGROUND

Figure 1:
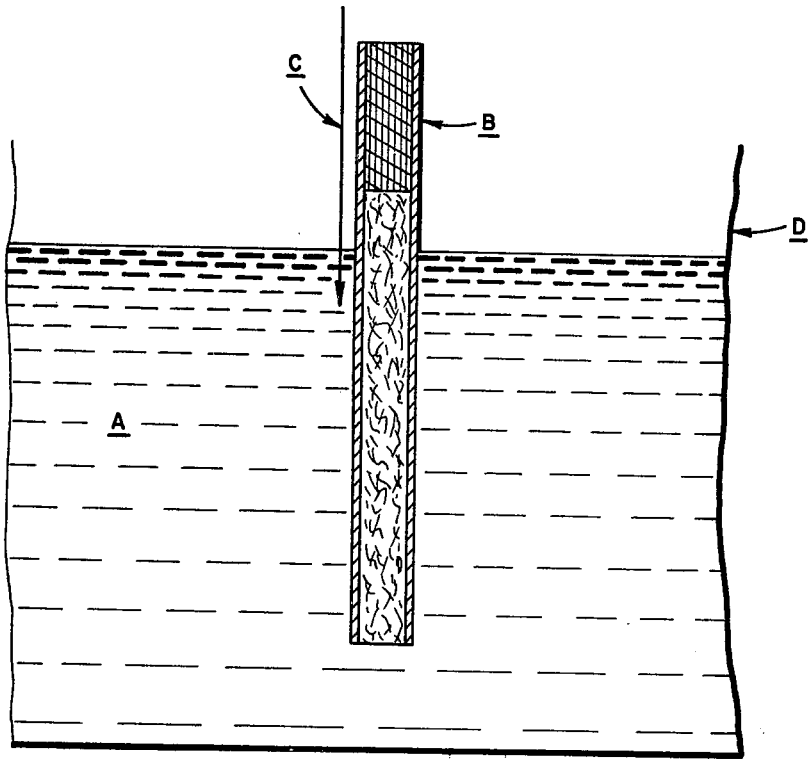

Fires initiated by smoldering cigarettes under a variety of circumstances, such as inadvertently being left in overstuffed furniture and unknowingly dropped into bedding, continues to take its toll in the loss of human lives and the destruction of property. The smoldering mechanism is believed to be significant to the catastrophic consequences in that it involves a time-lapse during which there appears to be no eventual problem and concomitantly provides a feeling of false security. This invention is related directly to the probability-of-occurrence aspect in that it reduces the free burning time of a "live" cigarette when left unattended, and thereby reduces the time period for smoldering to occur. In this invention there is cognizance of the requirements of an acceptable behavior of the treated cigarettes during smoking, and the avoidance of increase in the toxicity and health-related factors of the by-products of combustion. By the selection of certain additives to cigarettes, there should not necessarily be a conflict between providing for increased fire-protection safety and conformity in characteristics during normal usage.

SUMMARY OF THE INVENTION

This invention discloses the use of certain flame-retardants as additives to the tobacco and/or the paper housing of cigarettes for controlling the burning period or the time to self-extinguish when left unattended. The additives include boric acid, benzenephosphonic acid, and the aqueous reaction product between 2-moles of benzenephosphonic acid and 1-mol of melamine.

In the simultaneous treatment of the tobacco and the paper housing, controlled volumes of aqueous and, in some cases, isopropanol solutions of the flame-retardants are incorporated either directly or by immersing the cigarettes into their solutions for specific time periods. In the separate treatments of the tobacco and the cigarette paper housing, the flame-retardants are added as solutions to the tobacco and/or the paper housing in a manner so as to provide the desired weight percentage concentrations; after appropriate drying, the cigarettes are then assembled so as to contain weights of tobacco equivalent to the untreated, as-marketed products.

Determination of whether an ignited cigarette would self-extinguish if left unattended was conducted by supporting it in an upward position of approximately 30° from the horizontal so that the burning end was not in contact with any surface, and placed approximately four feet from the register of an operating, wall-mounted, forced air heater to augment the free access of air. Evidence of burning was monitored visually by the smoke emitted, with the expiration point verified by the manual drawing-of-air in a smoking situation, and the concomitant absence of combustion. Tests for self-extinguishing characteristics were made at various positions of each of the treated cigarettes as differing concentrations of additive could result by a process of displacement similar to that occurring in a liquid chromatographic procedure; these positions were the outer or first one inch, the middle or second one inch position, and the third one inch position closest to the filter end, identified respectively as (a), (b), and (c) in the illustrated examples.

Efficacy of a self-extinguishing cigarette, as related to the reduced probability of its involvement as a fire-initiating source, was substantiated by comparing the behavior of untreated and treated cigarettes inclined downward in contact with shredded paper, linen, and flexible polyurethane foam, and left unattended after ignition. In the case of the untreated cigarette, smoldering continued for greater than 10 minutes with periodic kindling, indicating a potential for subsequent flame-propagation. In the case of the treated cigarette, representative samples of which were previously determined to self-extinguish within approximately two minutes, there was no residual smoldering and no flaming during the test period.

Comparison of the quantity of the ambient temperature condensible products of cigarette combustion indicated no adverse change from the untreated to the treated cigarettes under the conditions of test in which the weight differential of cotton absorbers is quantitatively obtained after heating for 15 minutes at 100° C. prior to weighing; this property is identified as "net passed catch" in the related example that is presented.

FIG. 1 represents an application of self-extinguishing agent or agents to a cigarette by immersion.

DESCRIPTION OF THE INVENTION

Additives and methods of incorporation for treating the cigarette tobacco and/or the paper housing of the cigarette to render the assembly self-extinguishing when left unattended are disclosed. The additives are applied from aqueous and, in some cases, isopropanol solutions followed by drying or removal of the solvent. Note FIG. 1. A refers to a fluid medium containing a self extinguishing agent or agents. B refers to a common filter tip cigarette. C refers to the filter tip cigarette being immersed in a solution containing the self extinguishing agent or agents. D refers to a section of a larger bath of the self extinguishing solution. Additives found applicable for the intent of this invention are those of boric acid, benzenephosphonic acid, and the reaction product between 2-moles benzenephosphonic acid and 1-mol melamine from aqueous solution. The methods of incorporation that are to be discussed include: in situ additions are those in which their aqueous or isopropanol solutions are added to the assembled cigarettes either directly applied to the tobacco or by absorption through the paper casing upon immersion of the cigarettes into solutions of prescribed concentrations for prescribed periods of time; and external applications to both the tobacco and paper housing separately, prior to assembly, and to the paper housing only prior to assembly—it was determined that treatment of the tobacco only, sans the paper housing, was not as practically effective in meeting the objectives of this disclosure.

For the case of the in situ application by the direct addition of the additive solutions to the tobacco, controlled volumes, varying from approximately 0.5 to 1.5 ml per cigarette, of specified additive concentrations were added dropwise to the tobacco with the cigarette in a vertical position, depositing calculable weight percentages of additive based on the weight of the tobacco.

For the case of the in situ application by immersing the cigarettes in solutions of the additives, the cigarettes were suspended vertically and submerged, to the boundary of the filter tip, for controlled periods of time; the volume of solution absorbed during an immersion period of 1 to 4 seconds will generally vary from approximately 0.75 to 1.3 ml. depending on the cigarette size, the tobacco content and its characteristics, providing a range adequate for adjusting for the desired additive concentration in the treated cigarette.

For the case of the external application to both the tobacco and the paper housing, aqueous solutions of the additives were mixed into the tobacco in prescribed amounts, and both aqueous and isopropanol solutions of varying concentrations were used to treat the paper housings; for each, combinations of ambient temperature drying and heating at about 60° C. were used to remove the solvent carriers. In assembly of the cigarettes, the weight of treated tobacco was commensurate with the average packaged weight of the untreated Controls.

For the case of the external application of additive to only the tobacco, or to only the paper housing, the same procedures of tobacco treatment, paper housing treatment, and cigarette assembly were followed as for the case in which both the tobacco and paper casing were involved.

For each of the stated cases of additive application, drying is required to remove the solvent carrier; this comprised combinations of ambient drying at approximately 20° C. and heating at approximately 60° C. for time periods adequate to ensure that the physical characteristics of the treated cigarettes were comparable or equivalent to those of the untreated Controls.

The "cases" of treatment noted produce varying appearances. For cigarettes processed by the "in situ" addition of additives, the paper casing remains stained, due to tobacco migration, and may also become slghtly wrinkled. The color change can be substantially eliminated by the use of a darkened paper for the housing; wrinkling can be reduced by controlling the humidification during the drying period. For the cases of the separate treatment of the tobacco and the paper housing, there was no staining or wrinkling of the paper housing and therefore no adverse appearance change after the cigarettes were reassembled.

In the determination of burning time or self-extinguishing time, the cigarette was ignited by conventional means and then supported by the filter tip end with the burning portion freely suspended in an upward position of approximately 30° from the horizontal. Air movement around the lighted cigarette was augmented by activating a wall-mounted, fan-type heater placed approximately 4' from the test specimen. Termination of burning was detected by smoke evolution and manually "drawing" on the cigarette to determine whether it could be reignited. In each of the cases where self-extinguishment resulted, there was an obvious reduction in the extent of smoke evolution during the smoking period as compared to the untreated Controls, as well as a reduced rate-of-burn.

Comparison of the ambient temperature condensible products of cigarette combustion between selected treated compositions and their untreated Controls was made by smoking the cigarettes in a vertical position using a simulated smoking machine at a constant vacuum differential of 2" of water. The products of combustion not retained by the filter tip of the cigarette were caught by preweighed cotton plugs of 0.400 g. each, and the net increase in weight of the cotton absorber, heated for 15 min. at 100° C. before and after smoking, is termed "net passed catch". The net passed catch is believed to be a significant parameter as it reflects the relative quantity of combustion by-products that the smoker could inhale.

These and other aspects of the invention will be demonstrated, expanded on, and defined further in the examples set forth.

EXAMPLES OF THE INVENTION

Example 1

In this example, the results of which are given in Table I, cigarettes (Carlton 100's, a product of The American Tobacco Co.) were individually treated by adding aqueous and isopropanol solutions of additives selected from boric acid, benzenephosphonic acid (BPA), and the aqueous reaction product between 2-moles of BPA and 1-mol of melamine, [$(BPA)_2$-$(Melamine)_1$]; this procedure was referred to as the "in situ application by direct addition" under the section "Description Of The Invention". After combined ambient temperature and elevated temperature drying periods, these were tested for self-extinguishment at three locations for each cigarette, ie., at the outer, center, and inner portions previously noted and identified as positions (a), (b), and (c) under the section "Summary Of The Invention".

TABLE I

In Situ Application By Direct Treatment

| Vol. additive solution per cigarette | wt. % additive based on the wt. tobacco | Time in minutes to self-extinguish (a) | (b) | (c) |
|---|---|---|---|---|
| 1 ml 3.25% aq. boric acid | 5 | 1½ | 1½ | 1½ |
| 0.625 ml 5% aq. boric acid | 5 | 2 | 2 | 2 |
| 1 ml 1.625% aq. boric acid | 2.5 | 1½ | 2 | 2 |
| 0.6 ml 1.625% aq boric acid | 1.5 | 3 | 2 | 2 |
| 1 ml 3.25% aq. BPA | 5 | 1¼ | 1¼ | 1¼ |
| 1 ml 1.625% aq. BPA | 2.5 | 1½ | 2 | 2 |
| 1 ml 3.25% BPA in isopropanol | 5 | 1½ | 1½ | 1½ |
| 1 ml 1.625% BPA in isopropanol | 2.5 | 2 | 2 | 2½ |
| 1.5 ml 2% aq. $(BPA)_2(Melamine)_1$ | 5 | 1½ | 2 | 2 |

Notes
1 3.25% aq. boric acid refers to 3.25 g. boric acid per 100 ml. aq. solution.
2 5% aq. boric acid refers to 5 g. boric acid per 100 ml. aq. solution.
3 1.625% aq. boric acid refers to 1.625 g. boric acid per 100 ml. aq. solution.
4 3.25% aq. & 1.625% aq. BPA refers to 3.25 g. and 1.625 g. benzenephosphonic acid in 100 ml. aq. solutions, respect.
5 3.25% & 1.625% BPA in isopropanol refers to 3.25 g. and 1.625 g. BPA in 100 ml. of isopropanol solutions, respect.
6 2% aq. $(BPA)_2(Melamine)_1$ *refers to a warm (approximately 30° C.) solution of the "salt" in 100 ml. of aqueous solution.*

Example 2

In this example, the results of which are given in Table II, cigarettes of various brands were individually treated by immersing them into solutions of boric acid and benzenephosphonic acid of specified concentrations for specific time periods; this procedure was referred to as the "in situ application by immersion" under the section "Description Of The Invention".

TABLE II

In Situ Application By Immersion (Part A)

| | Immersion | Immersion | Wt. % additive | Burning time (min) |
|---|---|---|---|---|

TABLE II-continued

| Cigarette | In Situ Application By Immersion solution | time (sec) | of tobacco | (a) | (b) | (c) |
|---|---|---|---|---|---|---|
| Carlton 100 | 3% ag. boric acid | 2 | 4.6 | 1½ | 1½ | 1½ |
| Carlton 100 | 1.5% aq. boric acid | 2 | 2.3 | 2 | 2 | 2 |
| Carlton 100 | 3% aq. BPA | 2 | 4.6 | 1½ | 1½ | 1½ |
| Carlton 100 | 1.5% aq. BPA | 2 | 2.3 | 2 | 2 | 2 |
| Carlton 100 | 1.5% BPA isopropanol | 2 | 2.3 | 2 | 1½ | 2 |
| Carlton 100 | 1.5 $H_3BC_3$ plus 1.5% BPA (aqueous) | 2 | 4.6 | 1½ | 1½ | 1½ |

(Part B)

| Cigarette (Filter Tip) | Immersion time (sec) | Immersion Solution | Approximate time periods to self-extinguish |
|---|---|---|---|
| Kent Golden Light | 2 | 3 g. boric acid per 100 ml.aq.soln | Within 2 minutes |
| REAL | 2 | 3 g. boric acid per 100 ml.aq.soln | Within 2 minutes |
| TRUE (menthol) | 2 | "3%"aqueous boric acid sol'n. | Within 2 minutes |
| NOW | 2 | "3%"aqueous boric acid sol'n. | Within 2 minutes |
| TRUE | 2 | "3%"aqueous boric acid sol'n. | Within 2 minutes |
| MERIT | 2 | "3%"aqueous boric acid sol'n. | Within 2 minutes |
| VANTAGE | 2 | "3%"aqueous boric acid sol'n. | Within 2 minutes |
| L & M (Long Lights) | 2 | "3%"aqueous boric acid sol'n. | Within 3 minutes |
| Carlton (menthol) | 2 | "3%"aqueous boric acid sol'n. | Within 2 minutes |
| MORE 120's | 3 | "5%"aqueous boric acid sol'n. | Within 2 minutes |

Notes
1 "Burning time" is synonymous with "self-extinguishing" time, when left unattended.
2 Interpretation of the percent additives in aqueous and isopropanol solutions is the same as given under "Notes", Table I.
3 The weight % additives, ie., 4.6 and 2.3, for the Carlton 100's are averages based on the volumes of solution absorbed and the tobacco weights per cigarette.

Example 3

In this example, the results of which are given in Table III, tobacco and paper housings from Carlton 100's were separately treated with aqueous solutions of boric acid and after appropriate drying, the cigarettes were assembled to contain approximately the same weight of tobacco as the untreated Control. The time periods for self-extinguishment are the averages of multiple experiments.

TABLE III

| External Application, Boric Acid To Tobacco & Paper Housing | | | | |
|---|---|---|---|---|
| Tobacco Wt. $H_3BO_3$ | Paper Housing Wt. % $H_3BO_3$ | Approximate time periods (minutes) to self-extinguish (a) | (b) | (c) |
| 10 | 10 | 2½ | 2 | 2 |

Example 4

In this example, the tobacco was untreated and the paper housing was separately impregnated with approximately 10 wt.% of benzenephosphonic acid by saturating the housing with an alcoholic (isopropanol) solution containing 10 g. BPA per 100 ml. of solution. After removal of the isopropanol solvent, there appeared to be no adverse effect on the appearance or flexibility of the cigarette paper and no evidence of flaking of the BPA. Testing of the assembled cigarettes, containing about the same weight of untreated tobacco as in untreated Controls, gave self-extinguishing times of approximately 2-minutes (section a), 3½-minutes (section b), and 2½-minutes (section c) for an average of less than 3-minutes.

Example 5

In this example, the results of which are given in Table IV, cigarettes (Carlton 100's) treated and untreated were smoked in a vertical position using a mechanical simulated smoker to obtain the quantity of ambient temperature condensible combustion by-products, the differential weight of a 0.400 g. cotton plug (positioned downstream of the filter tip) heated 15 minutes at 100° C. prior to and after the cigarette "burn". These values are identified as "net passed catches", as noted in the section "Description Of The Invention", and represent those pyrolytic components that are not retained by the cigarette filter tip and can therefore be inhaled by the human smoker.

It is apparent by comparison of the data that, under the conditions of test, the treated cigarettes did not increase the concentration of the "condensible effluents". Further, observations during mechanical and manual smoking indicated uniformity of burning during both regimes, but with considerably less evolution of smoke and greatly reduced rate-of-burn for the treated cigarettes. The terminologies regarding additive application methods are those referred to under the section "Description Of The Invention". The drying conditions for each of the treated systems were combinations of ambient temperature exposure and heating at approximately 60° C.

TABLE IV

| Effluent Catch Tests (Part A) Treatment-Carlton 100's | Net Passed Catch (2" vac. $H_2O$ during mech.smoking) |
|---|---|
| No treatment-CONTROL | 11 mg. |
| Boric Acid-2.5 wt. % of tobacco In situ direct addition of 1 ml. of 1.625 g boric acid/100 ml aq sol'n. | 9 mg |
| Boric Acid-5 wt. % of tobacco In situ direct addition of 1 ml. of 3.25 g boric acid/100 ml aq sol'n. | 8 mg |
| Benzenephosphonic acid-2.5 wt. % tobacco In situ direct addition of 1 ml of 1.625 g BPA/100 ml. aq. sol'n. | 10 mg |
| Benzenephosphonic acid-5 wt. % tobacco In situ direct addition of 1 ml of 3.25 g BPA/100 ml. aq. sol'n. | 10 mg |
| Boric acid(approx 4.6 wt. % of tobacco) In situ by immersion for 2 seconds in a sol'n., 3 g $H_3BO_3$/100 ml. aq. sol'n. | 10 mg |
| Boric acid(approx 2.3 wt. % of tobacco) in situ by immersion for 2 seconds in a sol'n., 1.5 g $H_3BO_3$/100 ml. aq. sol'n. | 7 mg |
| BPA (approx 2.3 wt. % of tobacco) In situ by immersion for 2 seconds in a sol'n., 1.625 g BPA/100 ml isopropyl alcohol solution. | 3 mg |
| Boric acid 10 wt. % tobacco(separately treated) 10 wt. % paper casing(separately treated) (aqueous solutions) | 5 mg |

(Part B)

TABLE IV-continued

| Effluent Catch Tests | |
|---|---|
| MORE 120 cigarettes | |
| (R. J. Reynolds Tobacco Co.) | Net Passed Catch |
| No treatment-CONTROL | 41 mg |
| Boric Acid-5 wt. % of tobacco | |
| In situ direct addition of 1.29 ml. of | |
| 3.25 g.$H_3BO_3$/100 ml. aq. solution. | 35 mg |

I claim:

1. A self-extinguishing cigarette comprising a wrapper enclosing a charge of tobacco wherein benzenephosphonic acid is added to the wrapper in an effective amount so as to cause said cigarette to self extinguish when lit an unattended.

2. A self-extinguishing cigarette in accordance with claim 1 in which the self-extinguishing additive is present within a range of 2.5 to 5.5 weight percent of the weight of the tobacco smoking medium.

3. A self-extinguishing cigarette in accordance with claim 1 wherein said additive is applied to said cigarette by immersion of said cigarette in an aqueous solution of said benzenephosphonic acid under conditions so as to effectively cause said cigarette to self-extinguish when lit and left unattended for an amount of time between 1 and 3 minutes.

4. A self-extinguishing cigarette comprising a wrapper enclosing a charge of tobacco wherein the combination of boric acid and benzenephosphonic acid is added to the wrapper in an effective amount so as to cause said cigarette to self-extinguish when lit and unattended.

* * * * *